US006705933B2

(12) United States Patent
Ostermeier et al.

(10) Patent No.: US 6,705,933 B2
(45) Date of Patent: Mar. 16, 2004

(54) DEVICE FOR REGULATING AMOUNT OF LIQUID FED TO A HAND-HELD TOOL

(75) Inventors: Peter Ostermeier, Diessen (DE); Klaus Nagelschmied, Germering (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/120,653

(22) Filed: Apr. 11, 2002

(65) Prior Publication Data

US 2002/0151258 A1 Oct. 17, 2002

(30) Foreign Application Priority Data

Apr. 12, 2001 (DE) ..... 101 18 332

(51) Int. Cl.[7] ..... B24B 57/00
(52) U.S. Cl. ..... 451/446
(58) Field of Search ..... 451/344, 294, 451/295, 446, 359; 329/124, 123, 580, 581.2; 137/625.41; 222/47

(56) References Cited

U.S. PATENT DOCUMENTS 4,526,294 A * 7/1985 Hirschmann et al. ..... 222/47
4,615,485 A * 10/1986 Larson et al. ..... 239/124
RE32,575 E * 1/1988 Hundebol ..... 451/344
5,620,364 A * 4/1997 Torrance et al. ..... 451/359

* cited by examiner

*Primary Examiner*—Dung Van Nguyen
(74) *Attorney, Agent, or Firm*—Sidley Austin Brown & Wood, LLP

(57) ABSTRACT

A device for regulating an amount of liquid fed to a hand-held tool for treating a constructional component and including a base body (1) connectable to the hand-held tool (38), an outlet channel (2) extending parallel to an axis of the base body and an outlet opening of which is located in a region of the connection of the base body with the tool, an inlet channel (7) extending relative to the outlet channel at an angle from 20° to 90°, and a valve member (12) arranged in the base body (1) for connecting the inlet channel (7) with the outlet channel (2) and having a manually adjustable adjustment member (15).

9 Claims, 2 Drawing Sheets

DEVICE FOR REGULATING AMOUNT OF LIQUID FED TO A HAND-HELD TOOL

BACKGROUND OF THE INVENTION

1. Field of the Invention

The present invention relates to a device for regulating an amount of liquid fed to a hand-held too for treating a constructional component and including a base body having a connection element connecting the base body with the hand-held tool, an outlet channel extending parallel to an axis of the connection element and having an outlet opening located in a region of the connection element and an inlet channel with a valve member arranged in the base body for connecting the inlet channel with the outlet channel.

2. Description of the Prior Art

U.S. Pat. No. 5,620,364 discloses a tool for treating a constructional component and which is formed as a grinding tool and is rotated by using power of a running liquid. The liquid is fed to a base body connected with the grinding tool and, in particular, to a drive mechanism located inside the base body. The base body is provided with a handle and a valve having a manually operable adjustment element in form of a lever. The valve either provides for flow of the liquid to the tool or interrupts the liquid supply. In the operating position, in which the liquid flows to the tool, the lever is not secured.

An object of the present invention is to provide a liquid amount regulating device for a hand-held tool for treating constructional components and which would insure delivery a regulated constant amount of liquid.

SUMMARY OF THE INVENTION

This and other objects of the present invention, which will become apparent hereinafter, are achieved by providing a liquid amount regulating device in which the inlet channel extends at an angle from 20° to 90° with respect to the outlet channel, and the adjustment member is rotatable relative to the base body.

Because the inlet channel extends substantially transverse to the outlet channel, the liquid need not be delivered through the handle. The arrangement of the inlet channel at an angle relative to the outlet channel provides for a sidewise, with respect to the longitudinal extent of the base body, delivery of the liquid to the regulating device. The rotation of the adjustment member relative to the base body made possible an exact, stepless metering of the amount of liquid fed to the regulating device. For manufacturing reasons, the adjustment element is rotated about an axis coaxial with the longitudinal axis of the connection element that connects the device with the tool. Advantageously, the adjustment element is formed by a sleeve that surrounds the end region of the base body remote from the connection element. The sleeve has a small extent in a direction perpendicular to the longitudinal axis of the base body. In addition, the sleeve can be easily grasped by a tool operator and be rotated in the circumferential direction.

A particular rapid and reliable regulation of the amount of liquid, which is fed to the tool through the outlet channel, is achieved when the control member of the valve is located in a receiving bore formed in the base body, and there is provided a thread connection between the control member of the valve and the base body with a possibility of displacement of the control member parallel to the axis of the connection element. A dog member, which extends through at least one closed elongate opening formed in the base body and extending over a portion of a circumference of the base body, connects the control member with the adjustment member, thereby providing for cooperation of the adjustment member with the control member.

An automatic rotation of the adjustment member or the control member, which can be caused by vibrations acting on the base body, is prevented by providing a spring-biased pressure disc against biasing force of which the adjustment member has to be displaced in a direction away from the connection element. The biasing force of the pressure disc is transmitted from the adjustment member by the dog member to the control member, which results in a high friction in the thread connection means that connect the control member with the base body.

In order for the tool operator to ascertain, before opening of the valve that liquid from an external source is indeed supplied to the base body, the outlet channel is formed of two sections which cooperate with respective bores extending substantially transverse to the longitudinal extent of the base body and connected by respective connections bores with a circumferential channel that is formed in a housing surrounding the base body. The circulation of the liquid in the channel can be obverted through a transparent region of the housing.

In order for the transparent region to be oriented in a predetermined direction independent from the orientation of the base body, the housing is rotatable about the base body, and the transverse extending bores open into respective circumferential grooves formed in an outer surface of the base body and communicating with the respective connection bores.

The delivery of the liquid to the base body is often effected by using a flexible connection conduit which is often damaged when buckled. In order to prevent buckling of the delivery conduit to the most possible extent, the housing inlet bore has its outlet opening located in the inner surface of the housing, and an inlet mouth of the inlet channel is formed by a circumferential groove formed in an outlet surface of the base body. The outlet opening of the inlet bore and the circumferential groove lie in the same plane.

By connecting a flexible conduit to the housing rotatable about the base body, it is insured, particularly during treatment of walls that the conduit is always suspended from the housing transverse in the direction toward the floor.

In order for a user to be able to ascertain whether the liquid is constantly supplied to the working cite, preferably, the transparent region of the housing is formed by a transparent cover that covers the circumferential channel and that can be lifted from the rest of the housing. In addition a color ball is located in the circumferential channel. The liquid is so directed to the channel through the outlet channel section adjacent to the valve that the liquid flows through the channel in a predetermined direction before it flows out of the channel and into the next outlet channel section adjacent to the tool. The ball, which is located in the channel, is carried by the flowing liquid and constantly circulates through the channel. The user can see the circulation of the ball which is a sign that liquid flows through the channel. Instead of one ball, several color balls can be used. The advantage of using several balls consists in that it is easier for the user to see whether liquid flows through the channel at high liquid velocities, with the balls circulating likewise with a high speed.

The leakage of liquid through the gap between the housing and the base body is advantageously prevented by providing seals in opposite end regions of the base body and between the circumferential grooves. The seals are arranged between an inner surface of the housing and an outer surface of the base body. As a seal, e.g., an O-ring can be used which is arranged in a corresponding groove formed in the outer surface of the base body or in the inner surface of the housing, respectively.

In order to keep the dimension of the device in the direction transverse to the longitudinal extent of the outlet channel at a minimum, the control member, which cooperates with the adjustment member, is received in a bore formed in the base body. The control member is arranged in the receiving bore with a possibility of displacement in a direction parallel to the longitudinal extent.

Both the entry region of the inlet channel or of the inlet bore and the exit region of the outlet channel can be provided with valve-like protection elements to prevent any dirt from entering the valve that connects the inlet and outlet channels when the device is not connected with the tool and/or the liquid source.

The novel features of the present invention, which are considered as characteristic for the invention, are set forth in the appended claims. The invention itself, however, both as to the construction and its mode of operation, together with additional advantages and objects thereof, will be best understood from the following detailed description of preferred embodiments, when read with reference to the accompanying drawings.

BRIEF DESCRIPTION OF THE DRAWINGS:

The drawings show.

DETAILED DESCRIPTION OF THE PREFERRED EMBODIMENT

Figure 1:
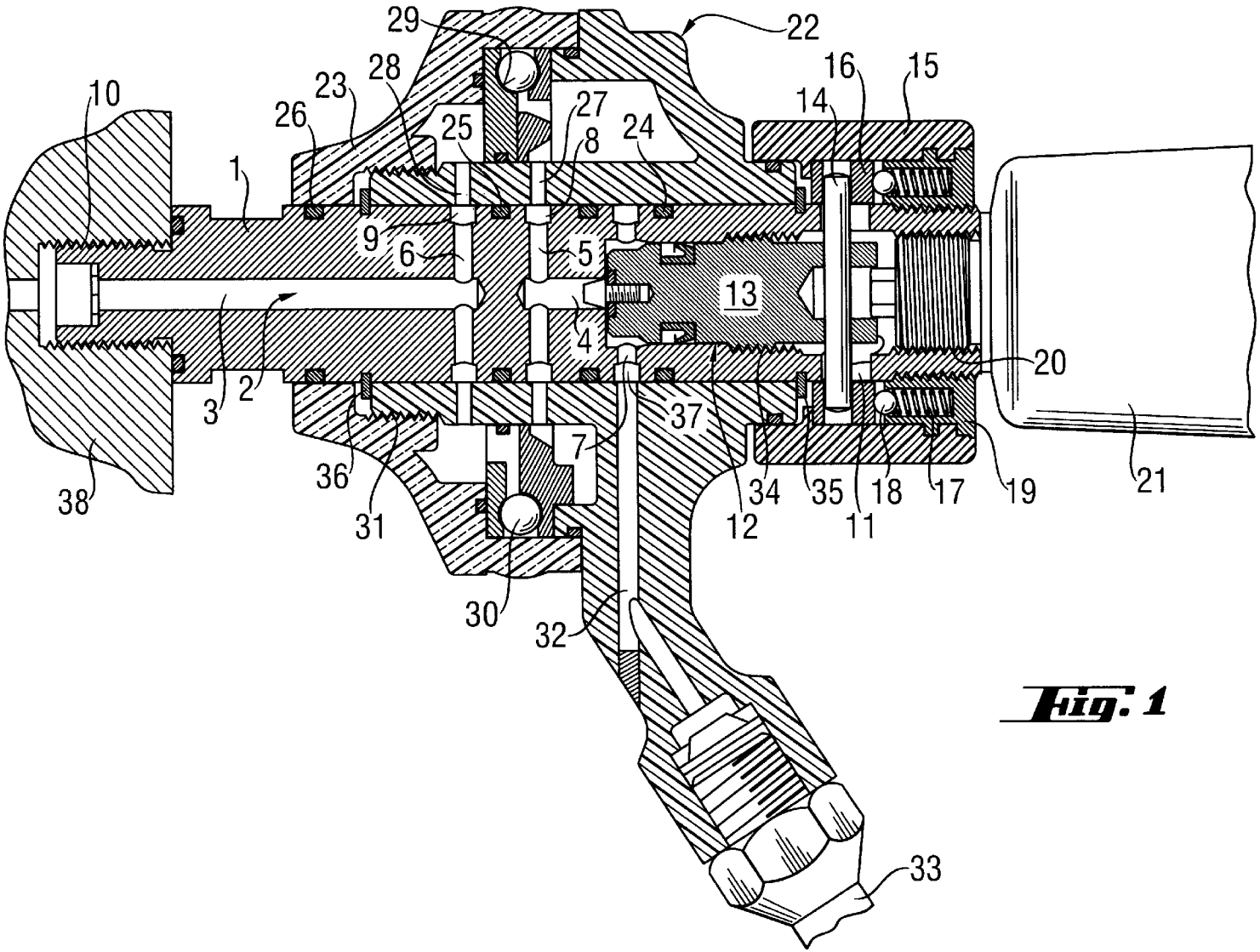
FIG. 1 a cross-sectional view of a device for regulating an amount of liquid fed to a hand-held liquid-driven tool for treating constructional components.
Figure 2:
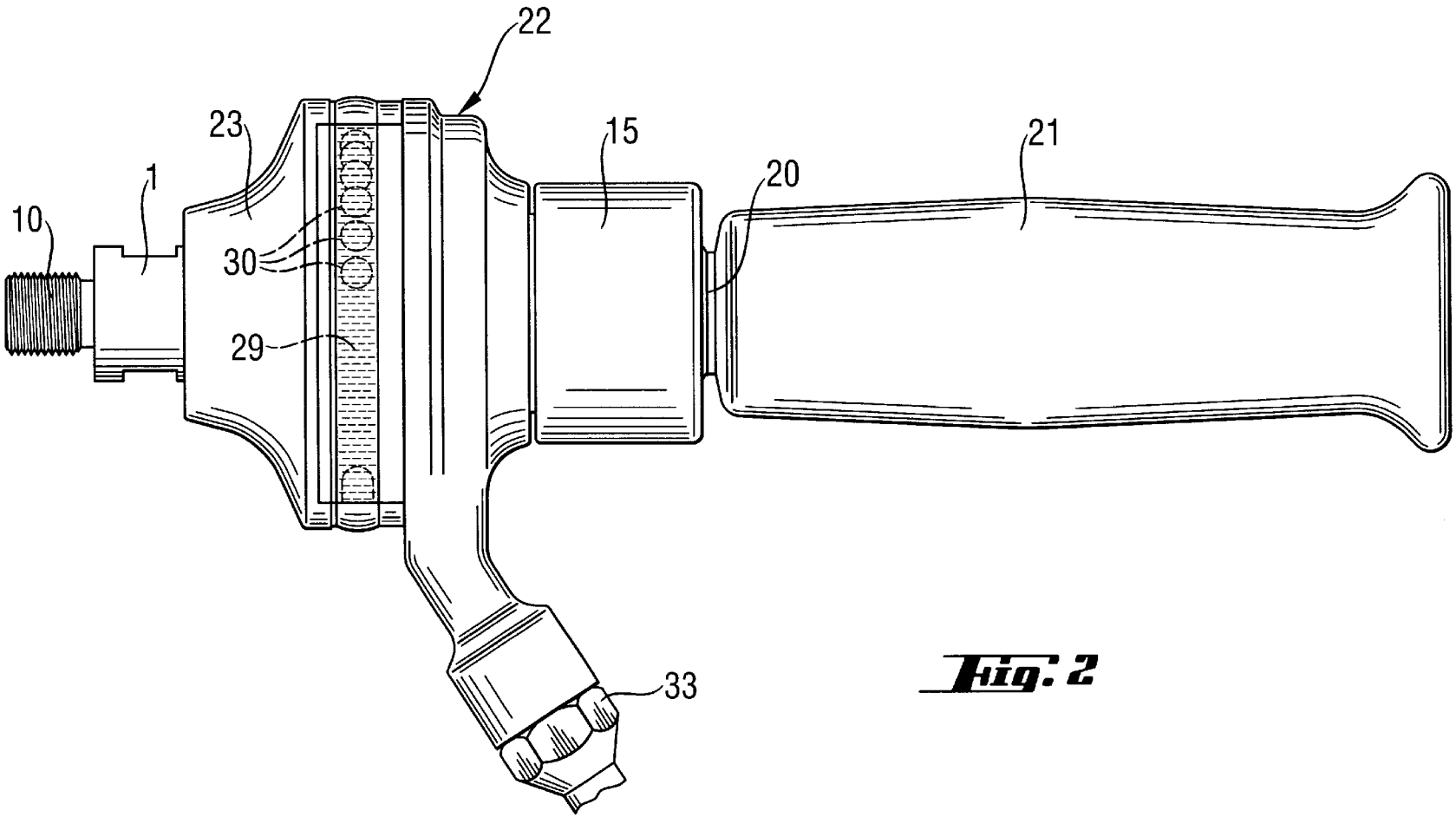
FIG. 2 a side view of the device shown in FIG. 1 connected with a handle, but without being connected to the tool.

FIGS. 1–2 show a liquid amount regulating device according to the present invention for a hand-held tool 38 for treating constructional components (with only an element of the tool being shown). The liquid amount regulating device, which projects sidewise of the tool 38, has a cylindrical base body I with an inlet channel 7, an outlet channel 2, and a valve 12 provided with a manual rotatable adjustment member 15. The regulating device is connected with the tool 38, at its end adjacent to the tool 38, by a threaded connection 10. At its opposite, remote from the tool 38, end, the regulating device has a handle 21 releasable connectable with the base body 1 by a threaded connection 20.

The outlet channel 2 extends parallel to the longitudinal axis of the threaded connection 10, i.e., parallel to the longitudinal extent of the base body 1, and extends from the valve 12 to an outlet opening provided in the end surface of the end region of the regulating device adjacent to the tool 38. The inlet channel 7 extends transverse to the longitudinal axis of the threaded connection 10 or transverse to the outlet channel 2, and preferably at an angle from 20° to 90°. The entry region of the inlet channel 7 adjoins a bottom of a circular groove 37 formed in the outer surface of the base body 1.

A valve 12 connects the inlet channel 7 with the outlet channel 2. The valve 12 extends parallel to the longitudinal extent of the base body 1. The valve 12 has a control member 13 which is secured in a bore formed in the base body 1 with thread connection means 34 provided between the control member 13 and the base body 1. The thread connection means 34 provides for displacement of the control member 13 parallel to the longitudinal extent of the base body 1. A dog member 14 connects the control member 13 with a sleeve-shaped adjustment member 15, providing for cooperation of the adjustment member 15 with the control member 13. The dog member 14 extends through opposite elongate openings 11 which extend over a portion of the base body circumference. On the outer profile of the base body 1, at the free end of the end region of the base body 1 remote from the tool 38, there is provided a stop sleeve 19 extending from the end surface of the remote end region to the elongate opening 11. The stop sleeve 19 is likewise connected with the base body 1 by a thread connection. The stop sleeve 19 has a circular stop surface facing in the direction toward the tool 38. A rotatable pressure disc 16 is supported against the stop surface by four springs 17 of which only two can be seen in FIG. 1. To reduce friction between the springs 17 and the pressure disc 16, balls 18 are arranged between the disc 16 and respective springs 17. The balls 18 form point contacts with the pressure disc 16.

The base body 1 is surrounded by a housing 22 having an inlet bore 32. The housing 22 can rotate about the base body 1. The inlet bore 32 has an outlet thereof, which coincides with the inner surface of the housing 22, located in the same plane as the circumferential groove 37 of the base body 1. Liquid is fed to the regulating device from an external source over a connection conduit 33.

The outlet channel 2 is formed of two sections 3, 4 each of which cooperates with a respective bore 5, 6 extending traverse to the longitudinal extent of the base body 1. Each of the bores 5, 6 opens in a respective circumferential groove 8, 9 formed in the outer surface of the base body 1. Each of the grooves 8, 9 is connected by a respective connection bore 27, 28 with a circumferential channel 29 formed in the housing 22. The inner space of the channel 29 is formed by a transparent cover 23 that covers the channel 29 and can be lifted off the housing 22. The cover 23 is connected with the base body 1 by a threaded connection. Two retaining rings 35, 36, which project into respective circumferential grooves formed in the outer surface of the base body 1, determine the axial position of the housing 22 with respect to the base body 1.

In both end regions of the housing 22 and between the two connection bores 27, 28, there are provided seals 24, 26, 25, respectively. The seals 24, 26, 25 are arranged between the inner surface of the housing 22 and the outer surface of the base body 1. The seals 24, 26 present leakage through the clearance between the housing 22 and the base body 1, and the seal 25 seals the two connection bores 27, 28 from each other. Each of the seals 24, 25, 26 is formed by an O-ring that projects into a groove formed either in the inner surface of the housing 22 or in the outer surface of the base body 1.

As it is particularly shown in FIG. 2, a plurality of balls 30, which may be colored, are located in the channel 30. The cross-section of the balls 30 substantially corresponds to the cross-section of the channel 29. When the liquid flows through the outlet channel 2 and the channel 29, the balls 30 constantly revolve about the base body 1. When the regulating device is so adjusted that a large amount of liquid is supplied to the tool 38, the rotational speed of the balls 30 in the channel 29 is very high. However, when a small amount of liquid is supplied to the tool 38, the rotational speed of the balls 30 in the channel 29 is very low.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A device for regulating an amount of liquid fed to a hand-held tool for treating a constructional component, comprising a base body (1) having connection means (10) for connecting the base body (1) with the hand-held tool (38), an outlet channel (2) extending parallel to an axis of the connection means (10) and having an outlet opening located in a region of the connection means (10), an inlet channel (7) extending relative to the outlet channel at an angle from 20° to 90°; and a valve member (12) arranged in the base body (1) for connecting the inlet channel (7) with the outlet channel (2) and having a manually adjustable adjustment member (15) rotatable relative to the base body (1), wherein the adjustment member (15) rotates about an axis coaxial with the axis of the connection means (10).

2. A liquid amount regulating device according to claim 1, wherein the adjustment member (15) is formed of a sleeve surrounding an end region of the base body (1) remote from the connection means (10).

3. A liquid amount regulating device according to claim 1, wherein the valve (12) includes control member (13) located in a receiving bore formed in the base body (1), and wherein the device further comprises thread means (34) for connecting the control member (13) of the valve (12) with a base body (1) with a possibility of displacement of the control member (13) parallel to the axis of the connection means (10), and a dog member (14) extending through at least one closed elongate opening (11) formed in the base body (1) and extending over a portion of a circumference of the base body (1) for connecting the control member (13) with the adjustment member (15), thereby providing for cooperation of the adjustment member (15) with the control member (13).

4. A liquid amount regulating device according to claim 1, wherein the adjustment member (15) is displaceable in a direction away from the connection means (10) against a biasing force of a spring-biased pressure disc (16).

5. A liquid amount regulating device according to claim 1, wherein the outlet channel (2) is formed of two sections (3, 4), and wherein the device further comprises a housing (22) surrounding the base body (1), a circumferential channel (29) formed in the housing (22) and visible through a transparent region of the housing, and means for connecting the outlet channel sections (3, 4) with the circumferential channel (29) and including two bores (5, 6) extending substantially transverse to the longitudinal extent of the base body (1) and cooperating with respective outlet channel sections (3, 4) and two connection bores (27, 28) formed in the housing (22) for connecting the transverse extending bores (5, 6), respectively, with the circumferential channel (29).

6. A liquid amount regulating device according to claim 5, wherein the housing (22) is rotatable about the base body (1), and wherein the transverse extending bores (5, 6) open into respective circumferential grooves (8, 9) formed in an outer surface of the base body (1) and communicating with the respective connection bores (27, 28).

7. A liquid amount regulating device according to claim 6, wherein the housing (22) has an inlet bore (32) having an outlet opening thereof located in the inner surface of the housing, wherein an inlet mouth of the inlet channel (7) is formed by a circumferential groove (37) formed in an outer surface of the base body (1); and wherein the outlet opening of the inlet bore (32) and the circumferential groove (37) lie in a same plane.

8. A liquid amount regulating device according to claim 5, wherein the transparent region of the housing (22) is formed by a cover (23) that covers the circumferential channel (29) and is liftable off a remaining portion of the housing, and wherein at least one ball (30) is located in the circumferential channel (29).

9. A liquid amount regulating device according to claim 5, further comprising seal means (24, 25, 26) provided at least in one of opposite end regions of the base body (11) and between the circumferential grooves (8, 9) and arranged between an inner surface of the housing (22) and an outer surface of the base body (1).

* * * * *